US006527119B1

(12) United States Patent
Markert et al.

(10) Patent No.: US 6,527,119 B1
(45) Date of Patent: Mar. 4, 2003

(54) ANGLEBOARD EDGE PROTECTOR

(75) Inventors: Gary G. Markert, Hawthorne Woods, IL (US); Lawrence R. Peck, Frankfort, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/946,310

(22) Filed: Sep. 5, 2001

(51) Int. Cl.[7] ..... B65D 85/48
(52) U.S. Cl. ..... 206/453; 206/586
(58) Field of Search ..... 206/453, 454, 206/586, 591, 593, 594; 248/345.1

(56) References Cited

U.S. PATENT DOCUMENTS 5,040,684 A * 8/1991 Knowles ..... 206/586
5,813,537 A * 9/1998 DeReu et al. ..... 206/453
6,234,314 B1 * 5/2001 Qiu et al. ..... 206/586

* cited by examiner

*Primary Examiner*—Jacob K. Ackun
(74) *Attorney, Agent, or Firm*—Donald J. Breh; Mark W. Croll; Lisa M. Soltis

(57) ABSTRACT

An edge or corner protector comprises an apex portion and a pair of leg members extending away from the apex portion so as to define an angle of approximately 90° therebetween. The apex portion and leg members are defined by a plurality of paper plies which have at least two different width dimensions. Relatively narrow and relatively broad paper plies are alternatively arranged with respect to each other whereby the apex portion and proximal portions of the leg members are formed by both the broad and narrow paper plies whereas distal portions of the leg members are formed only by the broad paper plies. In this manner, increased thickness and strength is provided within the apex and proximal portions of the leg members as needed, the distal portions of the leg members nevertheless facilitate mounting, positioning, and orientation of the edge or corner protectors upon edge or corner regions of articles to be protected, and a substantial reduction in the overall raw material cost is achieved.

24 Claims, 1 Drawing Sheet

ANGLEBOARD EDGE PROTECTOR

FIELD OF THE INVENTION

The present invention relates generally to angleboard edge protectors for protecting the corner or edge regions of individual packages, fragile articles or products, palletized loads, and the like, and more particularly to a new and improved angleboard edge protector which is uniquely constructed so as to protectively surround or envelop a corner or edge region of an individual package, fragile article or product, palletized load, or the like, yet simultaneously facilitates the reduction in the amount of paper required in order to fabricate the angleboard edge protector without sacrificing the integrity, strength, and protective qualities of the angleboard edge protector.

BACKGROUND OF THE INVENTION

Package, article, palletized load edge or corner protectors, corner post supports, and the like, are of course well-known in the packaging and shipping industries, and are accordingly widely used in connection with the shipping and transportation of various packages, articles, products, palletized loads, and the like, in order to protect the same during transit, wherein it is particularly desirable to protect the corner or edge portions or regions thereof. Typical or conventional edge or corner protectors, or corner post supports, are disclosed, for example, within U.S. Pat. No. 5,307,928 which issued to Bishop on May 3, 1994, U.S. Pat. No. 5,181,611 which issued to Liebel on Jan. 26, 1993, U.S. Pat. No. 5,175,041 which issued to Webb et al. on Dec. 29, 1992, U.S. Pat. No. 5,161,692 which issued to Knierim on Nov. 10, 1992, U.S. Pat. No. 5,131,541 which issued to Liebel on July.21, 1992, U.S. Pat. No. 5,048,689 which issued to McFarland on Sep. 17, 1991, U.S. Pat. No. 4,771,893 which issued to Liebel on Sep. 20, 1988, U.S. Pat. No. 4,399,915 which issued to Sorenson on Aug. 23, 1983, U.S. Pat. No. 3,955,677 which issued to Collingwood on May 11, 1976, and U.S. Pat. No. 3,536,245 which issued to Palmer on Oct. 27, 1970.

All of the aforenoted patented implements are basically similar to each other and representative of conventional corner or edge protectors in that the same comprise two laminated leg structures disposed at 90° with respect to each other so as to effectively define an interior region within which the corner or edge portion, of the particular article, product, package, or palletized load, to be protected is adapted to be disposed. The number of layers of paper, fiber board, corrugated board, or the like, from which the particular edge or corner protector is fabricated, plays an inherent part in determining or predetermining the strength of the particular edge or corner protector, or corner post support. However, it is also well-known in the packaging and shipping industries that the largest cost component inherent in connection with the manufacture of fabrication of the corner or edge protectors is the cost of the paper components per se or raw materials. It would therefore be desirable to substantially reduce the amount of paper raw materials that are required in connection with the manufacture or fabrication of such corner or edge protectors, however, care must be taken so as to ensure that the structural integrity and strength characteristics of the corner or edge protectors are not adversely compromised.

A need therefore exists in the art for a new and improved corner or edge protector wherein the amount of paper raw materials that are required in connection with the manufacture or fabrication of corner or edge protectors can be substantially reduced while simultaneously preserving the structural integrity and strength characteristics of each manufacture or fabricated edge or corner protector.

OBJECTS OF THE INVENTION

Accordingly, it is an object of the present invention to provide a new and improved angleboard edge or corner protector for use in connection with the protection of corner or edge regions of various articles, packages, products, palletized loads, and the like.

Another object of the present invention is to provide a new and improved angleboard edge or corner protector for use in connection with the protection of corner or edge regions of various articles, packages, products, palletized loads, and the like, whereby the new and improved angleboard edge or corner protector overcomes the various economic disadvantages characteristic of similar conventional or PRIOR ART edge or corner protectors.

An additional object of the present invention is to provide a new and improved angleboard edge or corner protector for use in connection with the protection of corner or edge regions of various articles, packages, products, palletized loads, and the like, wherein the unique and novel structure characteristic of the new and improved angleboard edge or corner protector constructed in accordance with the principles and teachings of the present invention enables edge or corner protector manufacturers to realize or achieve substantial savings in costs incurred in connection with the fabrication or manufacture of the edge or corner protectors.

A further object of the present invention is to provide a new and improved angleboard edge or corner protector for use in connection with the protection of corner or edge regions of various articles, packages, products, palletized loads, and the like, wherein the unique and novel structure characteristic of the new and improved angleboard edge or corner protector constructed in accordance with the principles and teachings of the present invention enables edge or corner protector manufacturers to realize or achieve substantial savings in costs incurred in connection with the fabrication or manufacture of the edge or corner protectors as a result of a reduction in the amount of raw material paper that is required to in fact fabricate or manufacture the edge or corner protectors.

A last object of the present invention is to provide a new and improved angleboard edge or corner protector for use in connection with the protection of corner or edge regions of various articles, packages, products, palletized loads, and the like, wherein the unique and novel structure characteristic of the new and improved angleboard edge or corner protector constructed in accordance with the principles and teachings of the present invention enables edge or corner protector manufacturers to realize or achieve substantial savings in costs incurred in connection with the fabrication or manufacture of the edge or corner protectors as a result of a reduction in the amount of raw material paper that is required to in fact fabricate or manufacture the edge or corner protectors, and yet, the structural integrity and strength characteristics of the fabricated or manufactured edge or corner protectors are not adversely compromised.

SUMMARY OF THE INVENTION

The foregoing and other objectives are achieved in accordance with the teachings and principles of the present invention through the provision of a new and improved edge or corner protector which comprises a predetermined number of plies of paper serially disposed atop each other so as to form a laminate when glued together, and wherein, alternative layers or lamina of the overall laminated edge or corner protector have different width dimensions. More particularly, for example, the edge or corner protector will be fabricated or manufactured from a plurality of alternating paper plies which have alternative width dimensions, and the paper plies are bent at a common central portion through means of an angle of 90° such that the resulting edge or corner protector comprises a common central apex portion and two leg portions disposed at an angle of 90° with respect to each other. The outermost paper plies of the edge or corner protector will have a width dimension of, for example, six inches (6.00") and the remaining alternating intermediate paper plies will have width dimensions of, for example, three inches (3.00") and six inches (6.00").

In this manner, the first half or proximal section of each leg portion which is disposed closest to the commmon apex portion of the edge or corner protector will comprise all of the paper plies forming the edge or corner protector whereby such first half or proximal section of each leg portion of the edge or corner protector will have a first predetermined caliper or thickness dimension, whereas the second half or distal section of each leg portion which is disposed furthest from the commmon apex portion of the edge or corner protector will comprise only the widest paper plies forming the edge or corner protector whereby such second half or distal section of each leg portion of the edge or corner protector will have a second predetermined caliper or thickness dimension which is less than the aforenoted first predetermined caliper or thickness dimension characteristic of the first half or proximal section of each leg portion of the edge or corner protector. In this manner, a substantial cost savings in paper raw materials can be achieved or realized while simultaneously preserving the structural integrity and strength characteristics of the edge or corner protector.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
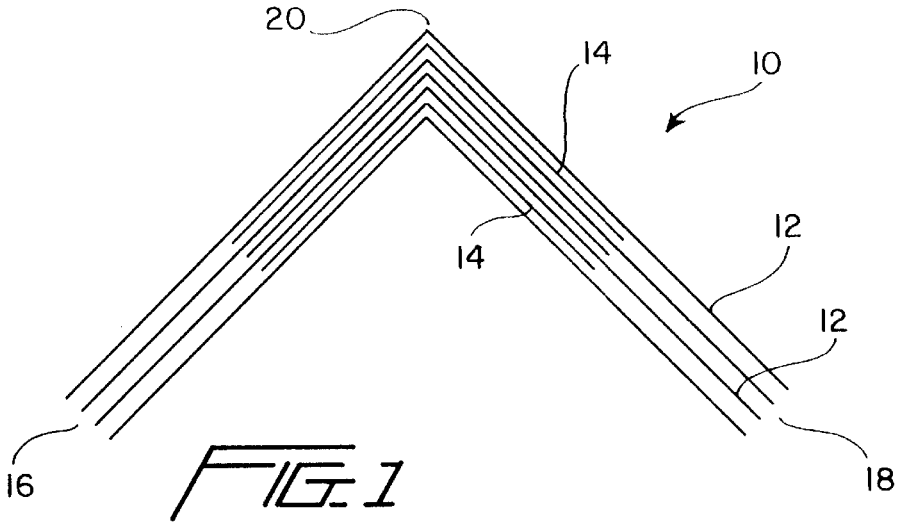
FIG. 1 is a schematic illustration, shown upon a relatively enlarged or exaggerated scale, of a new and improved edge or corner protector as constructed in accordance with the principles and teachings of the present invention and showing the cooperative parts thereof comprising the alternating relatively wide and relatively narrow width paper ply components wherein the paper plies have not as yet been glued and compressed together.
Figure 2:
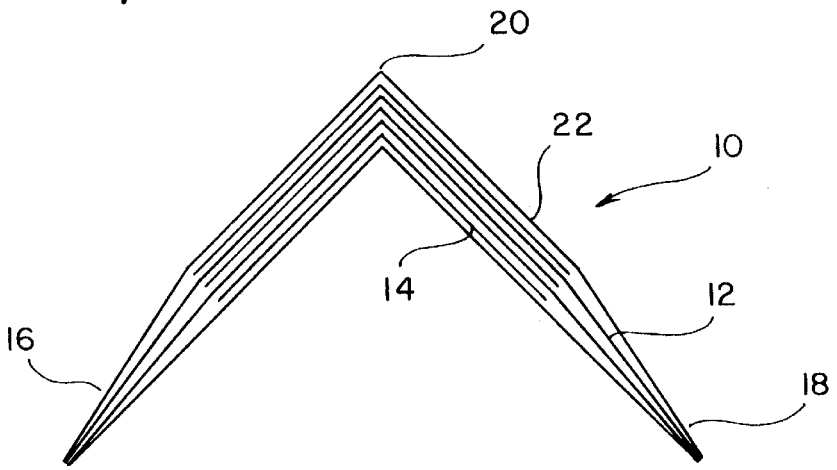
FIG. 2 is a schematic view corresponding substantially to the view of FIG. 1 showing, however, the new and improved edge or corner protector wherein the paper plies have been glued together but not necessarily compressed together in their finalized form so as to in fact form or define the commercially useable edge or corner protector.
Figure 3:
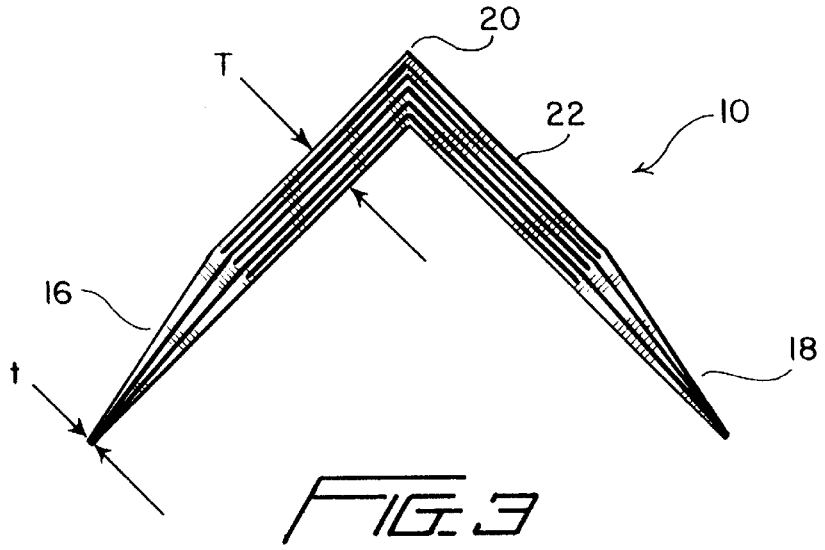
FIG. 3 is a schematic view corresponding substantially to those views of FIGS. 1 and 2 showing, however, the finalized commercial form of the edge or corner protector wherein after compression together of the alternating plies having the different width dimensions, it is relatively difficult to discern the disposition of such alternating paper plies whereby the resulting commercially useable edge or corner protector will exhibit satisfactory structural integrity and strength characteristics.

Referring now to the drawings, and more particularly to FIGS. 1–3 thereof, a new and improved edge or corner protector, constructed in accordance with the principles and teachings of the present invention, is disclosed and is generally indicated by the reference character 10. As can best or most clearly be appreciated from FIG. 1, which comprises a view of the new and improved edge or corner protector 10 upon an enlarged or exaggerated scale, it is seen that the new and improved edge or corner protector 10 comprises a first set of paper plies 12 all of which have the same relatively large predetermined width dimension, and a second set of paper plies 14 all of which have the same relatively small predetermined width dimension. It is further appreciated that the first set of paper plies 12 and the second set of paper plies 14 are substantially disposed in an overlapped, alternating mode, and that all of the paper plies comprising the first and second sets of paper plies 12,14 are bent at a central portion thereof, as considered in the widthwise direction, such that a first half of the paper plies 12 and a first half of the paper plies 14 together define a first leg 16 of the new and improved edge or corner protector 10, while a second half of the paper plies 12 and a second half of the paper plies 14 together define a second leg 18 of the new and improved edge or corner protector 10. An apex or corner region 20 is defined at the common bend point or line of each one of the first and second sets of paper plies 12,14 such that the first and second legs 16,18 are disposed at an angle of 90° with respect to each other.

In accordance with current or conventional techniques utilized in connection with the manufacture or fabrication of edge or corner protectors, the individual paper plies that comprise such conventional or PRIOR ART edge or corner protectors have predetermined width dimensions. Accordingly, in accordance with the techniques utilized in connection with the manufacture or fabrication of the new and improved edge or corner protector 10 comprising the present invention, each one of the paper plies 12 utilized within the first set of paper plies, as well as each one of the paper plies 14 utilized within the second set of paper plies will comprise a paper ply having one of the standard or conventional predetermined width dimensions. The critical importance or significance of the unique and novel structure characterized by means of the edge or corner protector 10 of the present invention resides in the use of paper plies having at least two different width dimensions. It is initially and additionally noted that while the new and improved edge or corner protector 10 of the present invention is illustrated as comprising, for example, only two sets of paper plies 12,14 having two different width dimensions, an edge or corner protector, constructed in accordance with the principles and teachings of the present invention, could comprise, for example, three or more sets of paper plies having three or more different width dimensions. It is further noted that the reasons for utilizing the different sets of paper plies comprising the different width dimensions are several, and in addition, they are all operatively or functionally interrelated.

Firstly, for example, it is known that an edge or corner protector must have a predetermined thickness or number of paper plies within the corner or apex region thereof in order to in fact provide or exhibit the requisite amount of protection and cushioning functions, as well as strength, required in connection with the protection of an edge or corner region of an article, product, package, or palletized load when the edge or corner protector is applied to or secured upon the particular article, product, package, or palletized load. Secondly, the overall width dimension of the edge or corner protector must be sufficient so as to facilitate the handling of the edge or corner protector and the orientation and positioning of the same with respect to and upon the edge or corner region of the particular article, product, package, or palletized load. Thirdly, it has been recognized and appreciated that the single largest cost incurred in connection with the manufacture or fabrication of edge or corner protectors comprises the cost of the raw material paper plies. Accordingly, it would be desirable to significantly reduce such manufacturing or fabricating costs by effectively reducing the overall amount of paper comprising a single edge or corner protector if such could in fact be achieved without, obviously, adversely affecting the structural integrity, strength, and protection properties of the edge or corner protector. As a result of the unique and novel structure comprising the edge or corner protector 10 of the present invention, the aforenoted objectives have in fact been achieved.

More particularly, by constructing the edge or corner protector 10 in accordance with the principles and teachings as illustrated, for example, within FIG. 1, wherein the relatively narrow set of paper plies 14 have been used in conjunction with the relatively wide set of paper plies 12 in an alternating or interdigitated manner, it is seen, for example, that a relatively thick region of the edge or corner protector 10 is defined within the vicinity of the apex portion 20. In particular, such apex portion 20, as well as the regions disposed immediately upon opposite sides thereof, is comprised of seven plies of paper as comprising the first and second sets of paper plies 12,14. It is of course to be noted that the precise number of paper plies, comprising the apex region 20 and those regions disposed immediately upon the opposite sides thereof, is not to be limited to seven. The important factor concerning the structure of the edge or corner protector 10 resides in the fact that the apex portion 20, as well as the regions disposed immediately upon the opposite sides thereof, is comprised of the maximum number of paper plies comprising the edge or corner protector 10, and in this manner, the maximum protection, cushioning, and strength characteristics are exhibited within the apex portion 20, as well as the regions disposed immediately upon the opposite sides thereof, so as to in fact afford the maximum protection to the edge or corner region of the particular article, product, package, or palletized load being protected.

Continuing further, as a result of those distal portions of each leg member 16,18 of the edge or corner protector 10, which are remote from the apex portion 20, being structurally defined in effect solely by means of the relatively wide first set of paper plies 12, although the protection, cushioning, and strength characteristics within such distal regions are not maximized as are such characteristics within the apex portion 20 and those proximal regions disposed immediately upon opposite sides of the apex portion 20, the need for such maximized characteristics within such distal regions, which are effectively removed from the apex, edge, or corner regions of the article, product, package, or palletized load, is not as great. What is important however, and what is nevertheless provided by means of the edge or corner protector 10 of the present invention as a result of the use of the relatively wide paper plies 12, is the provision to the edge or corner protector 10 of a sufficient overall width dimension which facilitates the handling, orientation, and positioning of the edge or corner protector upon the edge or corner region of the article, product, package, or palletized load prior to and in preparation for the fixed securement of the edge or corner protector upon the article, product, package, or palletized load by means of, for example, metal or plastic strapping, shrink or stretch wrapping, or the like.

Lastly, as a result of the aforenoted structure comprising the edge or corner protector 10 constructed in accordance with the principles and teachings of the present invention, a significant reduction in raw material paper costs is able to be achieved. For example, if each one of the paper plies comprising the first set of paper plies 12 has a width dimension of six inches (6.00"), and if each one of the paper plies comprising the second set of paper plies 14 has a width dimension of three inches (3.00"), then a paper cost savings of approximately twenty-five percent (25%) is able to be achieved. If, for example, each one of the paper plies comprising the second set of paper plies 14 has a width dimension of four inches (4.00"), then a paper cost savings of approximately seventeen percent (17%) is able to be achieved. It is to be further appreciated that the edge or corner protector 10 can be manufactured or fabricated from the aforenoted at least two sets of paper plies 12,14 having at least two different width dimensions wherein the particular width dimensions of either one of the first and second sets of paper plies 12,14 may vary as exemplified by means of the following examples:

EXAMPLE 1

| | |
|---|---|
| Width Dimension of Each Paper Ply Comprising The First Set of Paper Plies 12: | 6.00 Inches |
| Width Dimension of Each Paper Ply Comprising The Second Set of Paper Plies 14: | 5.00 Inches |

EXAMPLE 2

| | |
|---|---|
| Width Dimension of Each Paper Ply Comprising The First Set of Paper Plies 12: | 6.00 Inches |
| Width Dimension of Each Paper Ply Comprising The Second Set of Paper Plies 14: | 4.00 Inches |

EXAMPLE 3

| | |
|---|---|
| Width Dimension of Each Paper Ply Comprising The First Set of Paper Plies 12: | 6.00 Inches |
| Width Dimension of Each Paper Ply Comprising The Second Set of Paper Plies 14: | 3.00 Inches |

EXAMPLE 4

| | |
|---|---|
| Width Dimension of Each Paper Ply Comprising The First Set of Paper Plies 12: | 6.00 Inches |
| Width Dimension of Each Paper Ply Comprising The Second Set of Paper Plies 14: | 2.00 Inches |

EXAMPLE 5

| | |
|---|---|
| Width Dimension of Each Paper Ply Comprising The First Set of Paper Plies 12: | 5.00 Inches |
| Width Dimension of Each Paper Ply Comprising The Second Set of Paper Plies 14: | 4.00 Inches |

EXAMPLE 6

| | |
|---|---|
| Width Dimension of Each Paper Ply Comprising The First Set of Paper Plies 12: | 5.00 Inches |
| Width Dimension of Each Paper Ply Comprising The Second Set of Paper Plies 14: | 3.00 Inches |

EXAMPLE 7

| | |
|---|---|
| Width Dimension of Each Paper Ply Comprising The First Set of Paper Plies 12: | 5.00 Inches |
| Width Dimension of Each Paper Ply Comprising The Second Set of Paper Plies 14: | 2.00 Inches |

EXAMPLE 8

| | |
|---|---|
| Width Dimension of Each Paper Ply Comprising The First Set of Paper Plies 12: | 4.00 Inches |
| Width Dimension of Each Paper Ply Comprising The Second Set of Paper Plies 14: | 3.00 Inches |

EXAMPLE 9

| | |
|---|---|
| Width Dimension of Each Paper Ply Comprising The First Set of Paper Plies 12: | 4.00 Inches |
| Width Dimension of Each Paper Ply Comprising The Second Set of Paper Plies 14: | 2.00 Inches |

With reference now being made specifically to FIGS. 2 and 3, it is lastly noted that in connection with the actual manufacture or fabrication of the edge or corner protector 10, the entire outer peripheral surface of the edge or corner protector 10 is adapted to be wrapped within an outer wrapping layer 22, and the outer wrapping layer 22, as well as the individual paper plies 12,14, are adapted to be glued together so as to form the integral composite edge or corner protector 10. As shown in FIG. 2, for example, the various paper plies comprising the first and second sets of paper plies 12,14 are shown in their relative states before being compressed together, whereas as shown in FIG. 3, the first and second sets of paper plies 12,14 are shown in the their relative states after being compressed together whereby, once the first and second sets of paper plies 12,14 are in fact compressed together, it is difficult to discern the individual paper plies comprising the first and second sets of paper plies 12,14. Accordingly, all of the paper plies comprising the first and second sets of paper plies 12,14 together form, in effect, an integrated one-piece edge or corner protector structure. It is additionally noted that when the first and second sets of paper plies 12,14, together with the outer wrapping layer 22, are compressed together, the leg portions 16,18 of the edge or corner protector 10 will exhibit predetermined thickness dimensions within those regions adjacent to the apex portion 20 as well as within the distal tip regions of the leg portions 16,18 as denoted by the thickness dimensions T and t, respectively. More particularly, exemplary thickness dimensions T,t may be as follows:

EXAMPLE 10

| | |
|---|---|
| Maximum Thickness T Within Proximal Regions of Each Leg Portion 16, 18 | 0.250 Inches |
| Minimum Thickness t Within Distal Tip Regions of Each Leg Portion 16, 18 | 0.125 Inches |

EXAMPLE 11

| | |
|---|---|
| Maximum Thickness T Within Proximal Regions of Each Leg Portion 16, 18 | 0.225 Inches |
| Minimum Thickness t Within Distal Tip Regions of Each Leg Portion 16, 18 | 0.120 Inches |

EXAMPLE 12

| | |
|---|---|
| Maximum Thickness T Within Proximal Regions of Each Leg Portion 16, 18 | 0.200 Inches |
| Minimum Thickness t Within Distal Tip Regions of Each Leg Portion 16, 18 | 0.110 Inches |

EXAMPLE 13

| | |
|---|---|
| Maximum Thickness T Within Proximal Regions of Each Leg Portion 16, 18 | 0.180 Inches |
| Minimum Thickness t Within Distal Tip Regions of Each Leg Portion 16, 18 | 0.100 Inches |

EXAMPLE 14

| | |
|---|---|
| Maximum Thickness T Within Proximal Regions of Each Leg Portion 16, 18 | 0.160 Inches |
| Minimum Thickness t Within Distal Tip Regions of Each Leg Portion 16, 18 | 0.080 Inches |

Thus, it may be seen that in accordance with the principles and teachings of the present invention, there has been provided a new and improved edge or corner protector which substantially reduces the overall cost of fabrication or manufacture of the edge or corner protector by substantially reducing the amount of paper raw material required to be incorporated within the new and improved edge or corner protector without adversely affecting the protection, cushioning, strength, and structural integrity characteristics of the edge or corner protector and yet facilitating the handling, positioning, and orientation of the edge or corner protector upon a particular article, product, package, or palletized load. More particularly, the new and improved edge or corner protector comprises the use of two sets of paper plies characterized by two different width dimension values wherein both sets of paper plies are in effect present within the proximal apex corner portion of the edge or corner protector so as to provide the necessary protection to the edge or corner region of the particular article, product, package, or palletized load being protected, while only the wider width dimensioned paper plies are disposed within the distal regions of the leg members of the edge or corner protector so as to provide the edge or corner protector with the necessary width dimension in order to enable or facilitate the proper handling, orientation, and positioning of the edge or corner protector upon an edge or corner region of an article, product, package, or palletized load to be protected.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. An edge protector for protecting edge portions of articles when disposed and secured therearound, comprising:

an edge protector structure comprising a pair of leg members which are integrally connected together by means of an apex portion;

wherein said leg members are disposed at a substantially 90° angle with respect to each other and define proximal portions which are disposed adjacent to said apex portion, and distal portions which are disposed remote from said apex portion;

wherein each one of said pair of leg members and said apex portion comprises a plurality of material plies which are respectively bent at a substantially central portion substantially coinciding with and defining said apex portion of said edge protector structure; and wherein further, said plurality of material plies comprises a first set of material plies having a first relatively broad predetermined width dimension, and a second set of material plies having a second relatively narrow predetermined width dimension, whereby said apex portion and said proximal portions of said leg members of said edge protector structure are defined by both of said first and second sets of material plies, whereas said distal portions of said leg members are defined only by said first set of material plies.

2. The edge protector as set forth in claim 1, wherein:

each one of said plurality of material plies comprises a paper ply.

3. The edge protector as set forth in claim 1, wherein:

said plurality of material plies are secured together so as to form a laminate.

4. The edge protector as set forth in claim 1, wherein:

said plurality of material plies forming said second set of material plies are disposed between said plurality of material plies forming said first set of material plies such that said material plies forming said first and second sets of material plies are alternatively disposed with respect to each other.

5. The edge protector as set forth in claim 3, wherein:

said plurality of material plies forming said second set of material plies are disposed between said plurality of material plies forming said first set of material plies such that said material plies forming said first and second sets of material plies are alternatively disposed with respect to each other within said laminate.

6. The edge protector as set forth in claim 1, wherein:

said first relatively broad predetermined width dimension of said first set of material plies is within the range of four inches (4.00") to six inches (6.00"); and said second relatively broad predetermined width dimension of said second set of material plies is within the range of two inches (2.00") to five inches (5.00").

7. The edge protector as set forth in claim 1, wherein:

each one of said proximal portions of said leg members has a thickness dimension which is within the range of 0.160 inches to 0.250 inches; and each one of said distal portions of said leg members has a thickness dimension which is within the range of 0.080 inches to 0.125 inches.

8. The edge protector as set forth in claim 1, wherein:

said apex portion, and each one of said leg members, has an exterior surface portion which is adapted to be disposed away from an article when said edge protector is disposed around an edge portion of an article to be protected by said edge protector and secured at such position by packaging material, and an interior surface portion which is adapted to be disposed toward an article when said edge protector is disposed around an edge portion of an article to be protected by said edge protector and secured at such position by packaging material; and an outer wrapping is disposed around said interior and exterior surface portions of said apex portion and said leg members of said edge protector.

9. An edge protector for protecting edge portions of articles when disposed and secured therearound, comprising:

an edge protector structure comprising a pair of leg members which are integrally connected together by means of an apex portion;

wherein said leg members are disposed at a substantially 90° angle with respect to each other and define proximal portions which are disposed adjacent to said apex portion, and distal portions which are disposed remote from said apex portion;

wherein each one of said pair of leg members and said apex portion comprises a plurality of material plies which are respectively bent at a substantially central portion substantially coinciding with and defining said apex portion of said edge protector structure; and wherein further, said plurality of material plies comprises at least two sets of material plies wherein a first one of said at least two sets of material plies has a first relatively broad predetermined width dimension, and a second one of said at least two sets of material plies has a second relatively narrow predetermined width dimension, whereby said apex portion and said proximal portions of said leg members of said edge protector structure are defined by at least both of said first and second ones of said at least two sets of material plies, whereas said distal portions of said leg members are defined by at least one of said at least two sets of material plies.

10. The edge protector as set forth in claim 9, wherein:

each one of said plurality of material plies comprises a paper ply.

11. The edge protector as set forth in claim 9, wherein:

said plurality of material plies are secured together so as to form a laminate.

12. The edge protector as set forth in claim 9, wherein:

said plurality of material plies forming said second one of said at least two sets of material plies are disposed between said plurality of material plies forming said first one of said at least two sets of material plies such that said material plies forming said first and second ones of said at least two sets of material plies are alternatively disposed with respect to each other.

13. The edge protector as set forth in claim 11, wherein:

said plurality of material plies forming said second one of said at least two sets of material plies are disposed between said plurality of material plies forming said first one of said at least two sets of material plies such that said material plies forming said first and second ones of said at least two sets of material plies are alternatively disposed with respect to each other within said laminate.

14. The edge protector as set forth in claim 9, wherein:

said first relatively broad predetermined width dimension of said first one of said at least two sets of material plies is within the range of four inches (4.00") to six inches (6.00"); and said second relatively broad predetermined width dimension of said second one of said at least two sets of material plies is within the range of two inches (2.00") to five inches (5.00").

15. The edge protector as set forth in claim 9, wherein:

each one of said proximal portions of said leg members has a thickness dimension which is within the range of 0.160 inches to 0.250 inches; and each one of said distal portions of said leg members has a thickness dimension which is within the range of 0.080 inches to 0.125 inches.

16. The edge protector as set forth in claim 9, wherein:

said apex portion, and each one of said leg members, has an exterior surface portion which is adapted to be disposed away from an article when said edge protector is disposed around an edge portion of an article to be protected by said edge protector and secured at such position by packaging material, and an interior surface portion which is adapted to be disposed toward an article when said edge protector is disposed around an edge portion of an article to be protected by said edge protector and secured at such position by packaging material; and an outer wrapping is disposed around said interior and exterior surface portions of said apex portion and said leg members of said edge protector.

17. A corner protector for protecting corner portions of articles when disposed and secured therearound, comprising:

a corner protector structure comprising a pair of leg members which are integrally connected together by means of an apex portion;

wherein said leg members are disposed at a substantially 90° angle with respect to each other and define proximal portions which are disposed adjacent to said apex portion, and distal portions which are disposed remote from said apex portion;

wherein each one of said pair of leg members and said apex portion comprises a plurality of material plies which are respectively bent at a substantially central portion substantially coinciding with and defining said apex portion of said corner protector structure; and wherein further, said plurality of material plies comprises a first set of material plies having a first relatively broad predetermined width dimension, and a second set of material plies having a second relatively narrow predetermined width dimension, whereby said apex portion and said proximal portions of said leg members of said corner protector structure are defined by both of said first and second sets of material plies, whereas said distal portions of said leg members are defined only by said first set of material plies.

18. The corner protector as set forth in claim 17, wherein:

each one of said plurality of material plies comprises a paper ply.

19. The corner protector as set forth in claim 17, wherein:

said plurality of material plies are secured together so as to form a laminate.

20. The corner protector as set forth in claim 17, wherein:

said plurality of material plies forming said second set of material plies are disposed between said plurality of material plies forming said first set of material plies such that said material plies forming said first and second sets of material are alternatively disposed with respect to each other.

21. The corner protector as set forth in claim 19, wherein:

said plurality of material plies forming said second set of material plies are disposed between said plurality of material plies forming said first set of material plies such that said material plies forming said first and second sets of material are alternatively disposed with respect to each other within said laminate.

22. The corner protector as set forth in claim 17, wherein:

said first relatively broad predetermined width dimension of said first set of material plies is within the range of four inches (4.00") to six inches (6.00"); and said second relatively broad predetermined width dimension of said second set of material plies is within the range of two inches (2.00") to five inches (5.00").

23. The corner protector as set forth in claim 17, wherein:

each one of said proximal portions of said leg members has a thickness dimension which is within the range of 0.160 inches to 0.250 inches; and each one of said distal portions of said leg members has a thickness dimension which is within the range of 0.080 inches to 0.125 inches.

24. The corner protector as set forth in claim 17, wherein:

said apex portion, and each one of said leg members, has an exterior surface portion which is adapted to be disposed away from an article when said corner protector is disposed around a corner portion of an article to be protected by said corner protector and secured at such position by packaging material, and an interior surface portion which is adapted to be disposed toward an article when said corner protector is disposed around a corner portion of an article to be protected by said corner protector and secured at such position by packaging material; and an outer wrapping is disposed around said interior and exterior surface portions of said apex portion and said leg members of said corner protector.

* * * * *